US011053905B2

(12) United States Patent
Guengoer et al.

(10) Patent No.: US 11,053,905 B2
(45) Date of Patent: Jul. 6, 2021

(54) HOLDER AND SYSTEM HAVING A FUEL RAIL AND MULTIPLE HOLDERS

(71) Applicant: Robert Bosch GmbH, Stuttgart (DE)

(72) Inventors: Goekhan Guengoer, Eberdingen (DE); Herbert Blob, Nuremberg (DE)

(73) Assignee: Robert Bosch GmbH, Stuttgart (DE)

( * ) Notice: Subject to any disclaimer, the term of this patent is extended or adjusted under 35 U.S.C. 154(b) by 37 days.

(21) Appl. No.: 14/916,533

(22) PCT Filed: Jul. 9, 2014

(86) PCT No.: PCT/EP2014/064707
§ 371 (c)(1),
(2) Date: Mar. 3, 2016

(87) PCT Pub. No.: WO2015/032532
PCT Pub. Date: Mar. 12, 2015

(65) Prior Publication Data

US 2016/0195054 A1 Jul. 7, 2016

(30) Foreign Application Priority Data

Sep. 3, 2013 (DE) ..... 10 2013 217 515.9

(51) Int. Cl.
*F02M 61/14* (2006.01)
*F02M 63/02* (2006.01)
*F02M 55/02* (2006.01)

(52) U.S. Cl.
CPC ..... *F02M 63/0275* (2013.01); *F02M 55/025* (2013.01); *F02M 2200/03* (2013.01);
(Continued)

(58) Field of Classification Search
CPC ..... F02M 55/025; F02M 2200/855; F02M 2200/856; F02M 2200/857; F02M 2200/03; F02M 2200/8084; F02M 63/0275
(Continued)

(56) References Cited

U.S. PATENT DOCUMENTS 4,252,289 A 2/1981 Herb
2008/0302336 A1* 12/2008 Fuerst ..... F02M 55/025 123/470
(Continued)

FOREIGN PATENT DOCUMENTS

CN 102990308 A 3/2013
DE 202011005464 7/2011
(Continued)

OTHER PUBLICATIONS

International Search Report for PCT/EP2014/064707, dated Sep. 15, 2014.

*Primary Examiner* — Gonzalo Laguarda
(74) *Attorney, Agent, or Firm* — Norton Rose Fulbright US LLP; Gerard Messina

(57) ABSTRACT

A holder is used for fastening a fuel distributor to an internal combustion engine. The holder has a base element which is connected to the fuel distributor. A slotted sleeve is provided, which is connected to the base element, and the base element is braced on the internal combustion engine via the slotted sleeve. Furthermore, a system having the fuel distributor and a plurality of holders of this type is provided.

6 Claims, 1 Drawing Sheet

(52) U.S. Cl.
CPC ..... *F02M 2200/8084* (2013.01); *F02M 2200/855* (2013.01); *F02M 2200/857* (2013.01)

(58) Field of Classification Search
USPC ..... 123/469
See application file for complete search history.

(56) References Cited

U.S. PATENT DOCUMENTS

| | | | | |
|---|---|---|---|---|
| 2010/0313851 | A1* | 12/2010 | Di Domizio ..... | F02M 55/004 123/470 |
| 2013/0068198 | A1 | 3/2013 | Maier et al. | |
| 2013/0340714 | A1* | 12/2013 | Serra ..... | F02M 55/025 123/456 |
| 2014/0261332 | A1* | 9/2014 | Ramamurthy ..... | F02M 61/14 123/470 |
| 2015/0075496 | A1* | 3/2015 | Pasquali ..... | F02M 61/14 123/469 |

FOREIGN PATENT DOCUMENTS

| | | |
|---|---|---|
| DE | 102010062699 | 6/2012 |
| DE | 102012104480 B3 | 7/2013 |
| EP | 2495427 | 9/2012 |

* cited by examiner

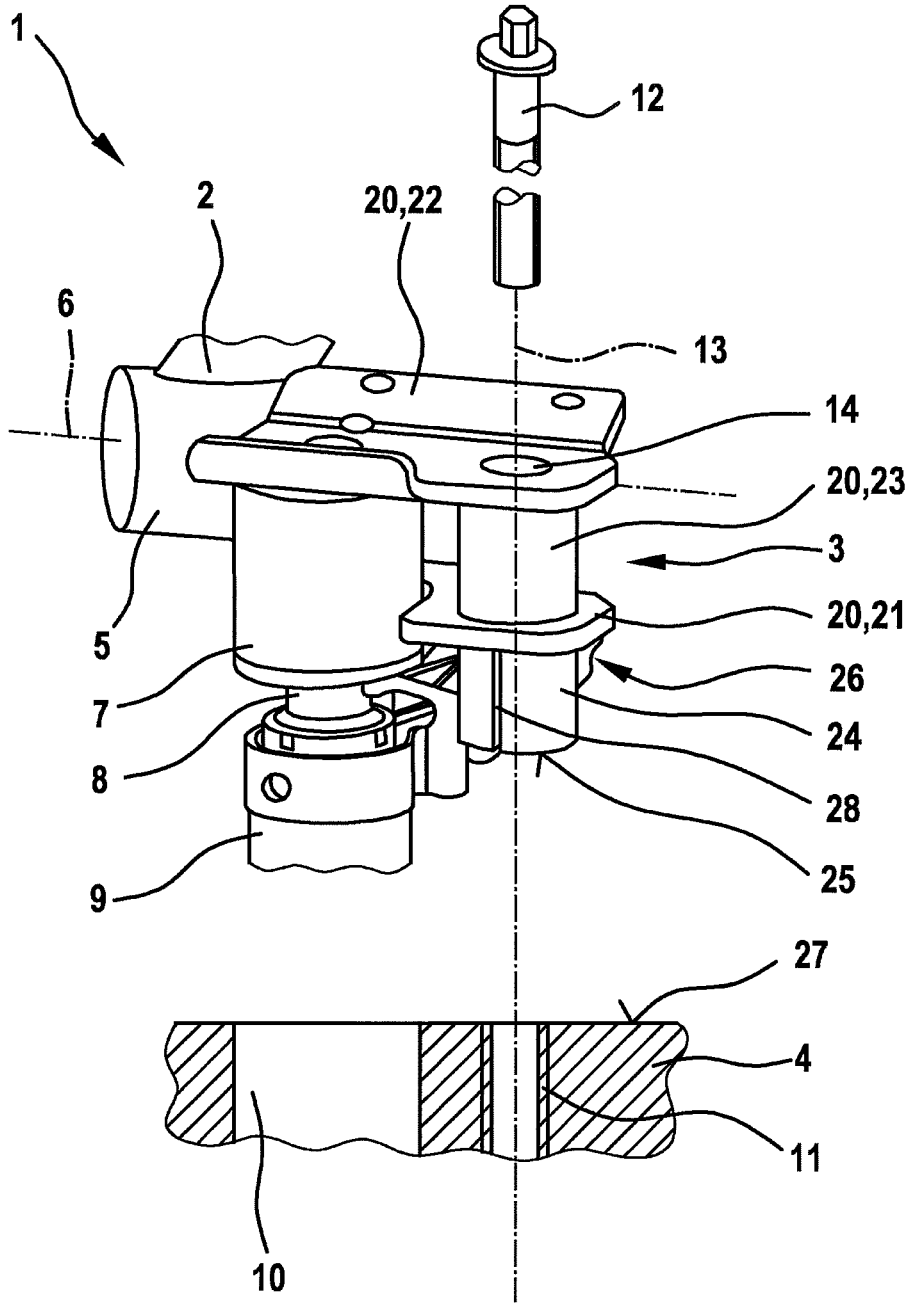
1
12
2
20,22
6
13
14
20,23
3
20,21
5
26
7
24
8
28
25
9
27
4
11
10

HOLDER AND SYSTEM HAVING A FUEL RAIL AND MULTIPLE HOLDERS

FIELD OF THE INVENTION

The present invention pertains to a holder for fastening a component, in particular a fuel distributor, to an internal combustion engine, and to a system having a component and multiple holders. In particular, the present invention relates to the field of fuel injection systems of internal combustion engines. The internal combustion engine can be operated on the basis of suitable fuels, such as gasoline, natural gas or diesel.

BACKGROUND INFORMATION

A fuel rail for gasoline and natural gas is known from German Published Patent Application No. 10 2010 062 699 A1. In this instance, a housing is provided on which holders are fixed in place on a cylinder head of the internal combustion engine, as attachment holders for fastening the entire fuel rail.

The fuel rail known from German Published Patent Application No. 10 2010 062 699 A1 is disadvantageous inasmuch as mechanical stresses arise during the operation, which, among other things, stress the connections between the attachment holders and the housing. This is so because the fuel rail is exposed to, inter alia, temperature loading that is the result of heating and cooling processes of the internal combustion engine. The reason for this is that the fuel rail and cylinder head are usually made from different materials and consequently have different coefficients of thermal expansion. Depending on the specific development of the fuel rail and the cylinder head, high local tensions arise in the region of the attachment holder during the operation, in particular in response to thermal expansion. The attachment holders are usually connected to the housing via solder areas having large dimensions, which requires a complete and flawless solder connection, so that the connection is ensured across the service life. This entails corresponding effort and expense and possibly testing in order to keep the failure rate to a minimum.

SUMMARY

The holder according to the present invention, and the system according to the present invention have the advantage of allowing a better development. In particular mechanical tensions that occur specifically as a result of changes in temperature (heating or cooling) of the internal combustion engine are able to be reduced.

It is advantageous that the slotted sleeve is connected to the base element via multiple spot connections. In particular, the slotted sleeve may be connected to the base element via multiple welding points, especially also by only two welding points. No surface connection but merely a spot connection is therefore provided, so that minor relative movements may occur between the slotted sleeve and the base element. In contrast to a linear welding seam, the stressing of the connection between the slotted sleeve and the base element is able to be reduced in this manner.

It is also advantageous that the base element has at least one holder part and the slotted sleeve is connected to the holder part of the base element. It is furthermore advantageous that the base element has an additional holder part and a sleeve, that the holder part is connected via the sleeve to the further holder part, and that a through passage extends along a fastening axis through the further holder part, the sleeve, the holder part, and the slotted sleeve. This results in a constructive development of the base element which is made up of multiple individual pieces. The base element may be composed of the further holder part, the sleeve, the holder part, and possibly further individual parts, punched and bent components and turned parts, in particular, being used for this purpose. Such a development of the base element is more cost-effective than a cast design. In one modified design, however, a cast base element may be used, as well, which then allows the realization of complex developments as the case may be, which are better adaptable to special space conditions. The connection of the base element and the component may be accomplished in different ways. If a large-area solder area is provided for the connection, then it will be subjected to lower stressing on account of the enabled micro-motions of the slotted sleeve.

Depending on the application case, the base element may thus be composed of a solid base construction or, in a cost-effective manner, of individual parts, for instance.

It is advantageous that a fastening means is able to be guided through the through opening along the fastening axis, so that the base element is indirectly connected to the internal combustion engine, and that the slotted sleeve has an uninterrupted annular contact face by way of which the sleeve is resting against a topside of the internal combustion engine when the base element is indirectly connected to the internal combustion engine. The base element is connected to the internal combustion engine, in particular a cylinder head of the internal combustion engine, with the aid of the fastening means and the slotted sleeve. The topside of the internal combustion engine against which the sleeve is resting with its contact face thus may in particular be the topside of the cylinder head of the internal combustion engine. The interruption of the annular contact face of the slotted sleeve results from the slotted design of the sleeve. During an operation this provides the advantage that when temperature changes occur, in response to which the cylinder head, for example, expands to a greater degree than the component, especially the fuel distributor (fuel rail), or a tubular element of the component, especially the fuel distributor, coercive forces occur at the contact face between the uninterrupted annular contact face of the slotted sleeve and the topside of the internal combustion engine, the slotted sleeve absorbing a portion of the coercive forces. Frictional forces between the uninterrupted annular contact face of the slotted sleeve and the topside of the internal combustion engine allow a certain frictional connection between the slotted sleeve and the internal combustion engine. Mechanical stresses at potentially critical locations are reduced as a result.

Moreover, it is advantageous in this context that the slot of the slotted sleeve is facing a longitudinal axis of the tubular element of the component, in particular a fuel distributor, or is facing away from this longitudinal axis. For then the slotted sleeve is able to absorb a portion of the coercive forces to a particularly large extent.

The slot of the slotted sleeve advantageously extends parallel to the fastening axis of the slotted sleeve, from the contact face of the slotted sleeve to a connection surface of the slotted sleeve facing away from the contact face. The point-wise spot connections with respect to the base element are then preferably provided on the connection surface of the slotted sleeve.

The base element of the holder thus may have a relatively stiff design, as usual for a cast base element or a constructed base element, since an offset along the longitudinal axis is possible via the slotted sleeve. The base element is advantageously developed as a constructed base element in this instance.

The orientation of the slot in the slotted sleeve is selected to match the thermal expansion. Furthermore, the connection of the slotted sleeve is preferably not implemented across the entire surface but rather in a point-for-point manner. Special welding points are used in this connection. These two measures, i.e., the slotted development of the sleeve and the connection at preferably just a few welding spots, make it possible to allow micro movements brought about by the temperature stressing. These micro movements contribute to a reduction in the stress increase.

In particular a development as constructed holder provided with a slotted sleeve makes it possible to derive a number of advantages. The stress at the soldering points is reduced, in particular between the holder and the component, especially the fuel rail. Since the slotted sleeve is not soldered to the rest of the system, in particular not to be base element, the operational stresses in this region is lower than would be the case in a (surface) soldered sleeve. In contrast, if the slotted sleeve was soldered to the base element across its full area, the stresses occurring at this additional soldering location in the course of an operation would be higher because gaps between the sleeve and base element would no longer be possible at this location. In addition, the natural frequencies of the system, in particular a fuel injection system or a fuel rail, would be shifted to higher ranges on account of the design of the sleeve.

BRIEF DESCRIPTION OF THE DRAWING

The FIGURE shows a system, which includes a component and a holder, as well as an internal combustion engine, in an excerpted, schematic three-dimensional representation that corresponds to an exemplary embodiment of the present invention.

DETAILED DESCRIPTION

The FIGURE shows a system 1 which includes a component 2 and a holder 3, as well as an internal combustion engine 4 in an excerpted, schematic three-dimensional representation that corresponds to an exemplary embodiment of the present invention. System 1, in particular, may be a fuel injection system 1 or part of a fuel injection system 1, in particular a fuel rail (fuel distributor). Component 2 may then be developed as a fuel rail, in particular a fuel distributor rail. Component 2 has a tubular body 5, which extends along a longitudinal axis 6.

In this exemplary embodiment, a cup 7 is installed on holder 3, which accommodates an inlet connection 8 of a fuel injector 9. Cup 7 is suitably connected to tubular base element 5 in order to convey fuel from tubular base element 5 via inlet connection 8 to fuel injector 9.

In the assembled state, fuel injector 9 extends inside a bore 10 of internal combustion engine 4, in particular a cylinder head 4 of internal combustion engine 4. In addition, a fastening bore 11, in particular a threaded bore 11, may be developed in such a cylinder head 4.

System 1 also has a fastening means 12, which is developed as a fastening screw 12 in this exemplary embodiment. During the assembly, fastening screw 12 is guided through a through hole 14 of holder 3 along a fastening axis and screwed into threaded bore 11. Component 2 then is fastened to internal combustion engine 4 via holder 3. At the same time, fuel injector 9 is fixed in place in bore 10 of internal combustion engine 4 via cup 7.

Holder 3 has a base element 20, which is developed in multiple parts in this exemplary embodiment. Base element 20 includes a holder part 21 and a further holder part 22. Holder parts 21, 22 may be developed in the form of sheet metal holders 21, 22. Furthermore, base element 20 has a sleeve 23 which is situated between holder parts 21, 22. The various parts of base element 20, in particular holder parts 21, 22 and sleeve 23, are interconnected in a suitable manner, especially by surface solder connections.

In addition, holder 3 has a slotted sleeve 24, which is connected to base element 20. In this exemplary embodiment slotted sleeve 24 is connected to holder part 21. The connection between slotted sleeve 24 and holder part 21 is realized by a few welding spots. Slotted sleeve 24 has a contact face 25 and a connection surface 26 which faces away from contact face 25. Slotted sleeve 24 is joined to holder part 21 at its connection surface 26 by way of the welding spots. As a result, slotted sleeve 24 is joined to holder part 21 not across its surface at its connection surface 26 but exclusively in a pointwise manner. Since slotted sleeve 24 is connected to base element 20 by way of multiple connection points, relative displacements between slotted sleeve 24 and holder part 21 are partially enabled, so that micro movements, in particular, are possible.

In this exemplary embodiment, through opening 14 extends consecutively through further holder part 22, sleeve 23, holder part 21, and slotted sleeve 24 along fastening axis 13. In the fastened state, in which fastening screw 12 is screwed into threaded bore 11 of internal combustion engine 4, slotted sleeve 24 is pressed against a topside 27 of internal combustion engine 4 at its contact face 25. Contact face 25 of slotted sleeve 24 is developed in such a way that it rests against top surface 27 of internal combustion engine 4 in a planar manner. As a result, contact surface 25 is developed as a continuous annular contact face 25, which is interrupted because of a slot 28 provided in slotted sleeve 24.

Different expansions of tubular element 5 and internal combustion engine 5 occur in the course of an operation as a result of temperature changes, in particular when internal combustion engine 4, especially cylinder head 4, is heated to the operating temperature. Tubular element 5 is connected to internal combustion engine 4 via at least one further holder, which may be developed according to holder 3. This difference in the changes in length basically leads to constraints or forces that, inter alia, result in mechanical stressing that occurs on holder 3.

A certain frictionally engaged connection is developed between contact face 25 of slotted sleeve 24 and top surface 27 of internal combustion engine 4. Because of the generated coercive forces, micro movements may occur due to the slotted design of slotted sleeve 24, slight relative displacements being possible at slotted sleeve 24, This makes it possible to absorb a portion of the coercive forces.

Slotted sleeve 24 therefore assumes the task of partially compensating for the different displacements of component 2 and cylinder head 4. The forced displacements at the fuel rail are reduced as a result, since a portion of the displacements is already absorbed by slotted sleeve 24. Less pronounced displacements thus arise at the remaining structure of system 1, in particular at component 2 and holder 3. This specifically reduces also the stresses at the soldered connections within holder 3 and between holder 3 and component 2. This applies accordingly also to differently developed connections. The operational stresses at system 1 are reduced as a result.

In this exemplary embodiment, slot 28 of slotted sleeve 24 is placed at slotted sleeve 24 in such a way that slot 28 faces away from longitudinal axis 6. Furthermore, slot 28 extends parallel to fastening axis 13. Such a directional assembly or placement of slotted sleeve 24 makes it possible to reduce the stresses in an especially effective manner. The reduction of the stresses at potentially critical locations is especially significant as a result. In a modified development, slot 28 may also face longitudinal axis 6, which likewise makes it possible to achieve a relatively effective reduction of the stresses. However, in principle other placements of slot 28 are conceivable as well.

As a result, coercive forces or mechanical stresses in the region of holder 3, in particular those produced due to temperature changes, are at least partially able to be absorbed in an effective manner. However, this advantageous effect may also be utilized for coercive forces or mechanical stresses that are not or only partially created by heat-related changes in length.

System 1 preferably has a multiplicity of holders, of which at least one holder is developed according to holder 3. However, multiple holders or even all holders of system 1 may be designed in accordance with holder 3.

The present invention is not restricted to the exemplary embodiments described.

What is claimed is:

1. A holder for fastening a component to an internal combustion engine, comprising:

a base element configured to connect to the component; and a slotted sleeve that is connected to the base element, wherein the base element is supported on the internal combustion engine at least via the slotted sleeve, wherein:

the base element includes at least one first holder part, at least one further holder part, and a further sleeve;

the slotted sleeve is connected to the first holder part;

the first holder part is connected to the further holder part via the further sleeve;

a through hole extends along a fastening axis through the further holder part, the further sleeve, the first holder part, and the slotted sleeve;

a fastening element is configured to be guided through the through hole along the fastening axis in order to connect the base element indirectly to the internal combustion engine;

the slotted sleeve has a connection surface that is spot connected to the first holder part;

the slotted sleeve has an annular contact face that is interrupted by at least one slot that is opposite to the connection surface; and the slotted sleeve is configured to rest on a surface of the internal combustion engine via the slot when the base element is indirectly connected to the internal combustion engine, wherein the at least one slot extends parallel to the fastening axis of the slotted sleeve from the contact face of the slotted sleeve to a surface of the slotted sleeve that is opposite to the connection surface of the slotted sleeve.

2. The holder as recited in claim 1, wherein the component includes a fuel rail.

3. The holder as recited in claim 1, wherein the slotted sleeve rests against the surface of the internal combustion engine via the annular contact face when the base element is indirectly connected to the internal combustion engine.

4. The holder as recited in claim 1, wherein:

the base element is developed in such a way that an orientation of a longitudinal axis of the component is predefined when connecting the base element to the component, and a slot of the slotted sleeve faces the longitudinal axis or faces away from the longitudinal axis.

5. A system, comprising:

a component; and a plurality of holders that fasten the component to an internal combustion engine, wherein at least one of the holders includes:

a base element configured to connect to the component, and a slotted sleeve that is at least indirectly connected to the base element, wherein the base element is braced on the internal combustion engine at least via the slotted sleeve, wherein:

the base element includes at least one first holder part, at least one further holder part, and a further sleeve;

the slotted sleeve is connected to the first holder part;

the first holder part is connected to the further holder part via the further sleeve:

a through hole extends along a fastening axis through the further holder part, the further sleeve, the first holder part, and the slotted sleeve;

a fastening element is configured to be guided through the through hole along the fastening axis in order to connect the base element indirectly to the internal combustion engine;

the slotted sleeve has a connection surface that is spot connected to the first holder part;

the slotted sleeve has an annular contact face that is interrupted by at least one slot that is opposite to the connection surface; and wherein the at least one slot extends parallel to the fastening axis of the slotted sleeve from the contact face of the slotted sleeve to a surface of the slotted sleeve that is opposite to the connection surface of the slotted sleeve, wherein the contact face of the slotted sleeve is configured to:

rest against a surface of the internal combustion engine in a planar manner; and frictionally engage the surface of the internal combustion engine, wherein the slotted sleeve is connected to the base element via multiple welding spot connections.

6. The system as recited in claim 5, wherein:

the component has a tubular body, and a slot of the slotted sleeve faces a longitudinal axis of the tubular body or faces away from the longitudinal axis of the tubular body.

* * * * *